US008231253B1

(12) United States Patent
Chen

(10) Patent No.: US 8,231,253 B1
(45) Date of Patent: Jul. 31, 2012

(54) ADJUSTABLE WINDOW CANDLE

(76) Inventor: Ching-Chao Chen, Hsinchu (TW)

( * ) Notice: Subject to any disclaimer, the term of this patent is extended or adjusted under 35 U.S.C. 154(b) by 123 days.

(21) Appl. No.: 12/978,405

(22) Filed: Dec. 23, 2010

(51) Int. Cl.
*F21V 21/22* (2006.01)

(52) U.S. Cl. ..... 362/393; 362/249.02; 362/249.16

(58) Field of Classification Search ..... 362/653, 362/249.06, 249.07, 249.16, 393
See application file for complete search history.

(56) References Cited

U.S. PATENT DOCUMENTS 1,114,299 A * 10/1914 Severus ..... 362/393
1,734,572 A * 11/1929 Gordon ..... 362/393
3,449,560 A * 6/1969 Bloom et al. ..... 362/431
* cited by examiner

*Primary Examiner* — David V Bruce
(74) *Attorney, Agent, or Firm* — Jackson IPG PLLC

(57) ABSTRACT

An adjustable window candle includes a candlestick, a positioning member mounted inside the shank body and having retaining flanges extending around the periphery thereof at different elevations, a candle shaft axially slidably sleeved onto the positioning device and having a locating groove extending around the inside wall thereof and selectively engageable with one retaining flange of the positioning member to secure the candle shaft to the positioning member in the candlestick in one of a series of elevational positions, and a lampshell mounted on a top end of the candle shaft and holding a LED lamp module therein.

4 Claims, 6 Drawing Sheets

ADJUSTABLE WINDOW CANDLE

BACKGROUND OF THE INVENTION

1. Field of the Invention

The present invention relates to window candles and more particularly, to an adjustable window candle, which allows the user to adjust the elevation of the candle shaft relative to a positioning device that is mounted inside the candlestick.

2. Description of the Related Art

A window candle has been a traditional practice in many cultures. Placing a candle in the window symbolizes the warmth and security of the family hearth and signals loyalty to family members and loved ones. Nowadays, many LED lamp type window candles have been created. A LED lamp type window candle generally comprises a base, a candlestick supported on the base, a candle shaft supported on the candlestick, and a lampshell supported on the candle shaft and a LED module mounted inside the lampshell and controllable to emit light through the lampshell. A conventional LED lamp type window candle does not allow adjustment of the elevation of the candle shaft, limiting the application.

SUMMARY OF THE INVENTION

The present invention has been accomplished under the circumstances in view. It is therefore the main object of the present invention to provide an adjustable window candle, which allows adjustment of the elevation of the candle shaft relative to the candlestick.

To achieve this and other objects of the present invention, an adjustable window candle includes a candlestick, a positioning member mounted inside the shank body and having retaining flanges extending around the periphery thereof at different elevations, a candle shaft axially slidably sleeved onto the positioning device and having a locating groove extending around the inside wall thereof and selectively engageable with one retaining flange of the positioning member to secure the candle shaft to the positioning member in the candlestick in one of a series of elevational positions, and a lampshell mounted on a top end of said candle shaft and holding a LED lamp module therein.

Further, the positioning member comprises at least one longitudinal sliding groove located on the periphery, and the candle shaft comprises at least one longitudinal sliding rail respectively slidably coupled to the at least one longitudinal sliding groove of the positioning member to guide axial movement of the candle shaft relative to said positioning member and to prohibit rotation of the candle shaft relative to the positioning member, avoiding electrical wire damage or electrical contact failure due to rotation of the candle shaft.

Further, the diameter of the bottom end of the candle shaft is smaller than the diameter of the receiving hole of the candlestick, assuring positioning stability.

DETAILED DESCRIPTION OF THE INVENTION

Figure 1:
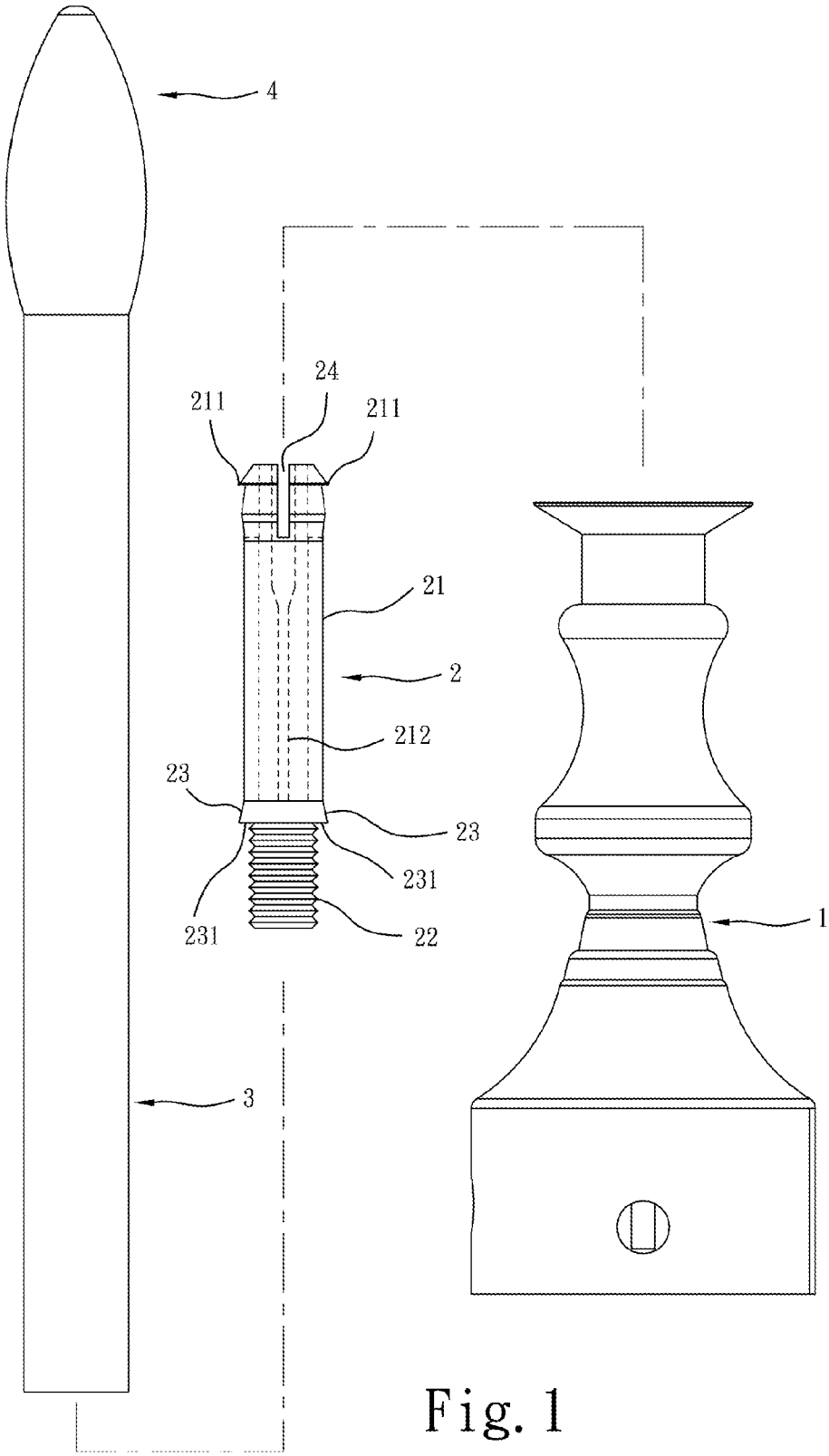
FIG. 1 is an exploded view of an adjustable window candle according to the present invention.
Figure 2:
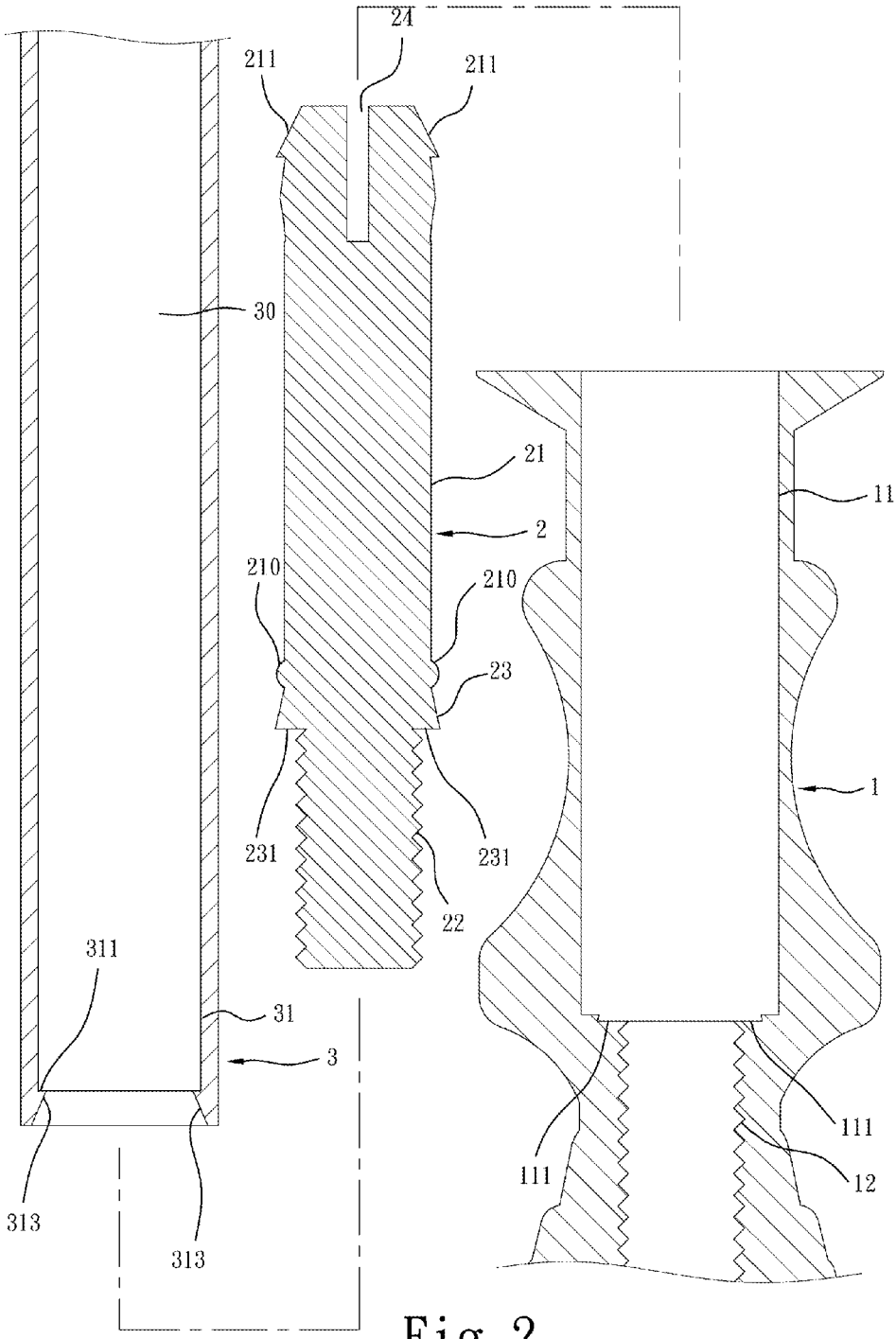
FIG. 2 is an enlarged view in section of FIG. 1.
Figure 3:
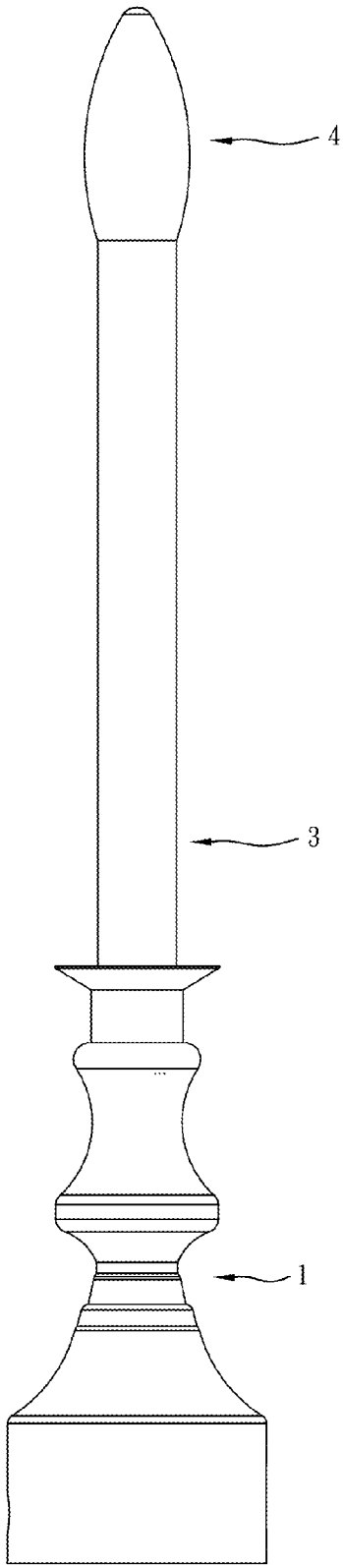
FIG. 3 is a plain assembly view of the adjustable window candle according to the present invention.
Figure 4:
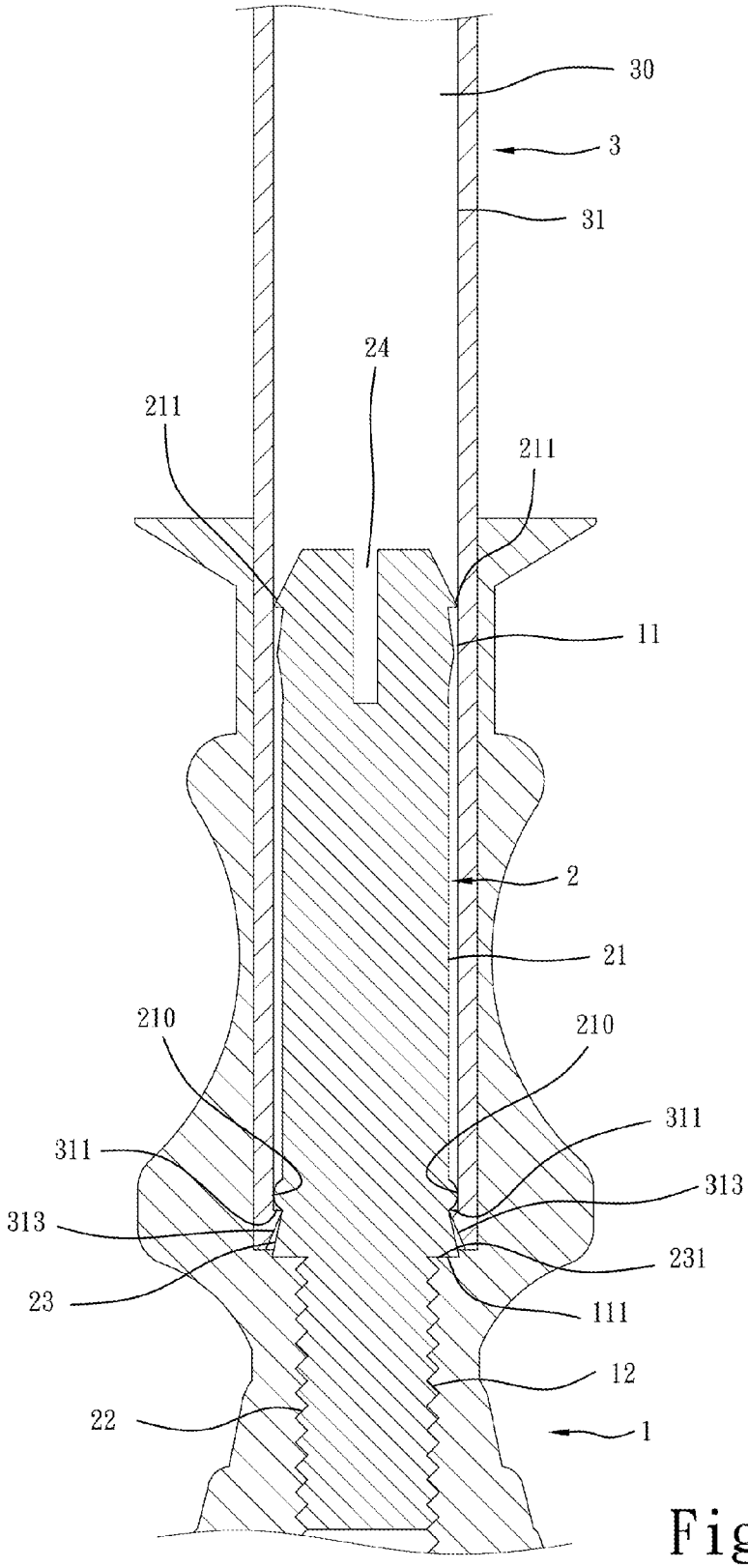
FIG. 4 is a sectional view in an enlarged scale of a part of FIG. 3.
Figure 5:
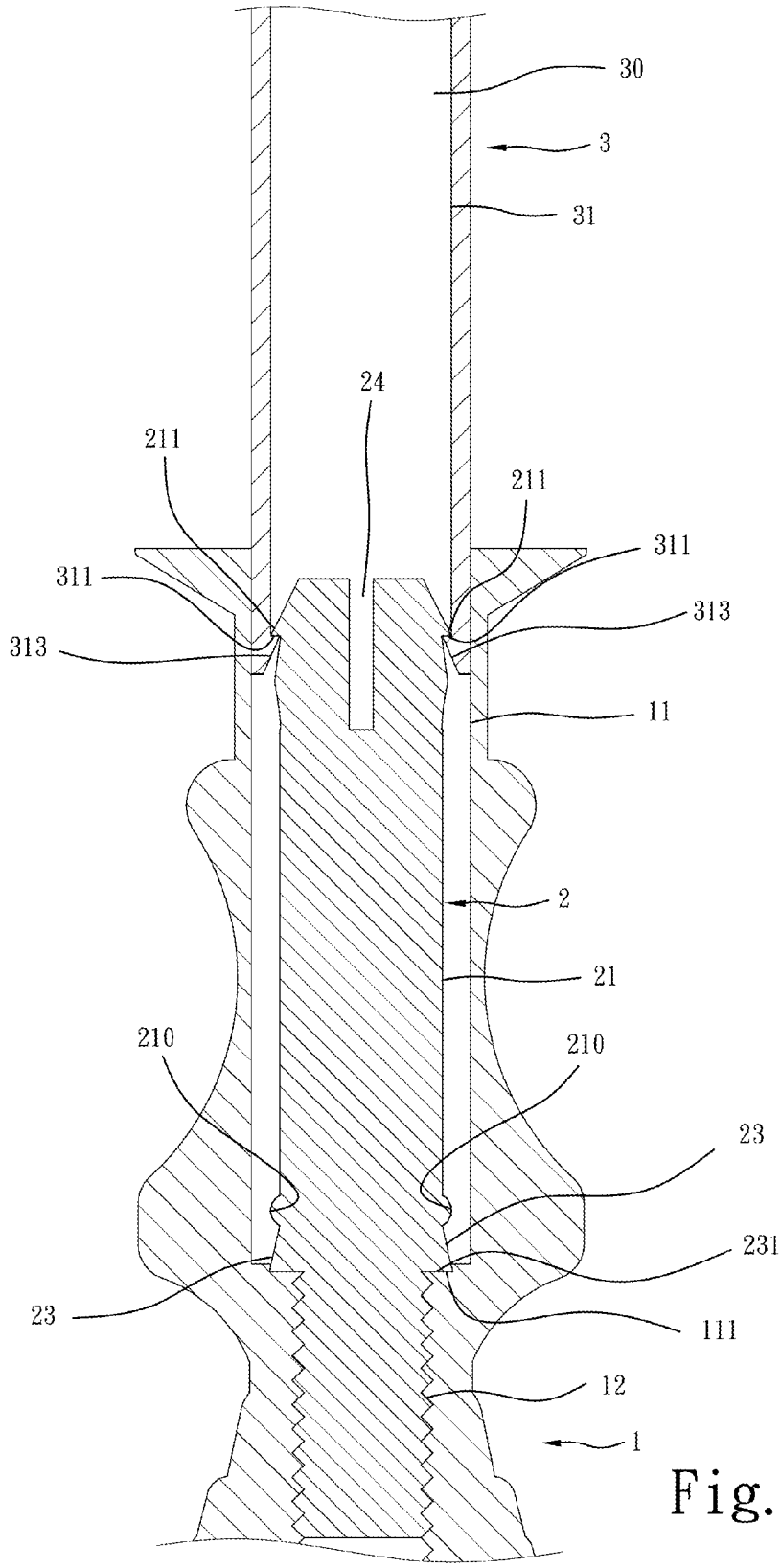
FIG. 5 is similar to FIG. 4 but illustrating the elevation of the candle shaft adjusted.
Figure 6:
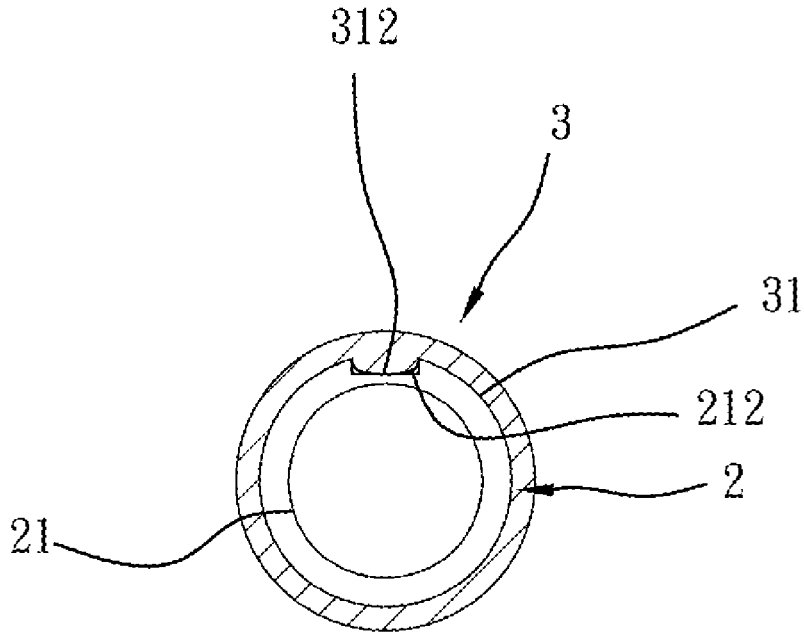
FIG. 6 is a cross-sectional view of the adjustable window candle according to the present invention, illustrating the longitudinal sliding rail of the candle shaft coupled to the longitudinal sliding groove of the positioning member.

Referring to FIGS. 1~6, an adjustable window candle in accordance with the present invention is shown comprising a candlestick 1, a positioning member 2, a candle shaft 3 and a lampshell 4.

The candlestick 1 comprises a receiving hole 11 axially downwardly extending from the topmost edge thereof to a predetermined depth (see FIG. 2), a screw hole 12 axially downwardly extending from the bottom side of the receiving hole 11 and having a diameter smaller than that of the receiving hole 11, and a shoulder 111 defined therein between the receiving hole 11 and the screw hole 12.

The positioning member 2 comprises a shank body 21 suspending in the receiving hole 11 of the candlestick 1, and a screw rod 22 axially downwardly extended from the bottom end of the shank body 21 and threaded into the screw hole 12 in the candlestick 1. The shank body 21 has retaining flanges 210;211 extending around the periphery at different elevations, and at least one longitudinal sliding groove 212 located on the periphery (see FIG. 6). The maximum diameter of the shank body 21 is smaller than that of the receiving hole 11 of the candlestick 1.

The candle shaft 3 is a hollow shaft member having an axial hole 30 axially extending to the bottom end thereof, at least one locating groove 311 extending around the inside wall 31 that defines the axial hole 30 and selectively engageable with the retaining flange 210 or 211 of the positioning member 2 to secure the candle shaft 3 to the positioning member 2 in the candlestick 1 in one of a series of elevational positions (see FIGS. 4 and 5), at least one longitudinal sliding rail 312 (see FIG. 6) respectively slidably coupled to the at least one longitudinal sliding groove 212 of the positioning member 2 to guide axial movement of the candle shaft 3 relative to the positioning member 2 and to prohibit rotation of the candle shaft 3 relative to the positioning member 2.

The lampshell 4 is fastened to the top end of the candle shaft 3 and adapted for accommodating a LED lamp module (not shown), which comprises a circuit board and at least one LED installed in the circuit board, and a cable adapted for electrically connecting the circuit board to an external power supply.

Further, the diameter of the bottom end of the candle shaft 3 is smaller than the diameter of the receiving hole 11 of the candlestick 1.

Further, the shank body 21 of the positioning member 2 has a conical bottom end portion 23 that is formed integral with one end of the screw rod 22 and has a diameter gradually reducing in direction away from the screw rod 22; the candle shaft 3 has a conical bottom end portion 313 located on the bottom end of the inside wall 31 (see FIG. 4) that that has a diameter gradually upwardly reducing toward the inside of the candle shaft 3 and facilitates insertion of the shank body 21 of the positioning member 2 into the inside of the candle shaft 3. When the candle shaft 3 is lowered to force the bottom-sided locating groove 311 into engagement with the bottom-sided retaining flange 210 of the positioning member 2, the conical bottom end portion 313 of the inside of the candle shaft 3 is rested on the conical bottom end portion 23 of the positioning member 2, and the bottom edge 231 of the conical bottom end portion 23 of the positioning member 2 is stopped at the shoulder 111 in the receiving hole 11 of the candlestick 1.

Further, the positioning member 2 is made of an elastic plastic material, having a longitudinal crevice 24 axially downwardly extended from the topmost edge thereof to a predetermined depth to enhance compressibility of the top end thereof. Further, the circuit board of the lampshell 4 can be electrically connected to city power supply, or alternatively, a battery pack can be used to provide the lampshell 4 with the necessary working voltage.

In conclusion, the adjustable window candle of the present invention has the following advantages and features:

1. The locating groove 311 of the candle shaft 3 can be selectively forced into engagement with the retaining flanges 210;211 of the shank body 21 and supported on the positioning member 2 in one of a series of elevational positions.
2. The at least one longitudinal sliding rail 312 of the candle shaft 3 is respectively slidably coupled to the at least one longitudinal sliding groove 212 of the positioning member 2 to guide axial movement of the candle shaft 3 relative to the positioning member 2 and to prohibit rotation of the candle shaft 3 relative to the positioning member 2, preventing electrical damage or electrical contact failure due to rotation of the candle shaft 3. Further, the diameter of the bottom end of the candle shaft 3 is slightly smaller than the diameter of the receiving hole 11 of the candlestick 1, assuring positioning stability.
3. Adjustment of the elevation of the window candle is easy and convenient.

What is claimed is:

1. An adjustable window candle, comprising;

a candlestick having a receiving hole axially downwardly extending from the topmost edge thereof to a predetermined depth, a screw hole axially downwardly extending from said receiving hole and a shoulder defined therein between said receiving hole and said screw hole, said screw hole having a diameter smaller than said receiving hole;

a positioning member, said positioning member comprising a shank body axially suspending in said receiving hole of said candlestick and a screw rod axially downwardly extended from a bottom end of said shank body and threaded into said screw hole in said candlestick, said shank body comprising a plurality of retaining flanges extending around the periphery thereof at different elevations, and at least one longitudinal sliding groove located on the periphery thereof, the maximum diameter of said shank body being smaller than said receiving hole of said candlestick;

a candle shaft being a hollow shaft member, said candle shaft comprising an axial hole axially extending to a bottom end thereof, at least one locating groove extending around an inside wall and selectively engageable with said at least one retaining flange of said positioning member to secure said candle shaft to said positioning member in said candlestick in one of a series of elevational positions, and at least one longitudinal sliding rail respectively slidably coupled to the at least one longitudinal sliding groove of said positioning member to guide axial movement of said candle shaft relative to said positioning member and to prohibit rotation of said candle shaft relative to said positioning member; and a lampshell mounted on a top end of said candle shaft and holding a LED lamp module therein.

2. The adjustable window candle as claimed in claim 1, wherein the diameter of the bottom end of said candle shaft is smaller than the diameter of said receiving hole of said candlestick.

3. The adjustable window candle as claimed in claim 1, wherein said shank body of said positioning member comprises a conical bottom end portion that is formed integral with one end of said screw rod and has a diameter gradually reducing in direction away from said screw rod; said candle shaft comprises a conical bottom end portion located on the bottom end of the inside wall thereof that has a diameter gradually upwardly reducing toward the inside of said candle shaft.

4. The adjustable window candle as claimed in claim 1, wherein said positioning device is made of an elastic plastic material, having a longitudinal crevice axially downwardly extended from the topmost edge thereof to a predetermined depth.

* * * * *